United States Patent [19]

Johnson

[11] Patent Number: 4,910,952

[45] Date of Patent: Mar. 27, 1990

[54] METHOD AND APPARATUS FOR MAKING A FRAYLESS LINE

[76] Inventor: Dale Johnson, R.R. #1, Box 36, Campbell, Nebr. 68932

[21] Appl. No.: 198,130

[22] Filed: May 24, 1988

[51] Int. Cl.[4] ..... D01H 7/02; D07B 3/12

[52] U.S. Cl. ..... 57/27; 57/314; 57/354

[58] Field of Search ..... 57/314, 362, 352, 354, 57/21, 25, 26, 27, 201; 87/8

[56] References Cited

U.S. PATENT DOCUMENTS

| | | | |
|---|---|---|---|
| 473,886 | 4/1892 | McDavitt | 57/26 |
| 800,774 | 10/1905 | Turner | 57/27 |
| 1,275,103 | 8/1918 | Swanson | 57/25 X |
| 1,467,539 | 9/1923 | Draper | 57/27 |
| 1,510,691 | 10/1924 | Meyer | 57/27 |
| 1,948,460 | 2/1934 | Hamburger etal. | 57/25 X |
| 2,363,404 | 11/1944 | Drake et al. | 57/26 |
| 2,935,838 | 5/1960 | Briscoe | 57/21 |
| 3,704,578 | 12/1972 | Myers | 57/352 X |

FOREIGN PATENT DOCUMENTS

| | | | |
|---|---|---|---|
| 592912 | 8/1925 | France | 57/27 |
| 74730 | 4/1917 | Switzerland | 57/27 |

*Primary Examiner*—Joseph J. Hail, III

*Attorney, Agent, or Firm*—Bernard L. Kleinke; William Patrick Waters; Jerry R. Potts

[57] ABSTRACT

A method and apparatus for manufacturing a frayless line is disclosed. The device includes a winder with a plurality of individually rotatable hooks mounted on its surface that rotates in a concurrent direction to the hooks, a spreader for separating groups of strands in a spaced apart manner at a selected point so the strand groups may be freely and easily twisted together, and a slidable rotatable support for twisting a plurality of individual group of strands together to form a line.

5 Claims, 4 Drawing Sheets

23A
23B
23C
50
40
60
10A
21
38
41
51
61
46
10
14
14A
15
15A
66
67
73
74
75
42
43
44
45
47
48
53
54
56
57
58
59

METHOD AND APPARATUS FOR MAKING A FRAYLESS LINE

TECHNICAL FIELD

The present invention relates in general to frayless lines, and methods and apparatus for making them. More particularly, the present invention relates to a method and apparatus for manufacturing a frayless line, such as a rope having both ends thereof finished.

BACKGROUND ART

Lines, such as ropes of various sizes and kinds have been utilized for many years, and many are of similar design and appearance, and are generally formed by means of twisting strands of fibrous materials, or groups of strands together. However, such strands do not readily maintain their twisted-together relationships and have a tendency to untwist unless they are otherwise secured together and thus restrained in their twisted relationship.

To overcome this problem, various means have been employed to produce ropes with finished ends. For example, in U.S. Pat. No. 2,109,717, there is showing a technique for forming a twisted belt, which starts by providing an endless loop and twisting it into a cable. Thereafter, the ends of the cable are patched together and then twisted.

As another example, in U.S. Pat. No. 2,805,540 there is disclosed a technique where the ends of the rope are tied together prior to twisting into a cable or belt. From the foregoing, it should be clear that many methods of making frayless ropes require that the free ends of the strands forming the rope be connected together by some fastening means, or otherwise tied together, which technique is usually time consuming and requires special manufacturing processes.

As another example, in U.S. Pat. No. 2,935,838, there is disclosed a method of making bands of yarn, wherein a pair of strands of yarn are twisted individually at one end, and the opposite end is also twisted. The twisted strands are then secured together to prevent unraveling by means of a band hook which is forced together to secure the twisted ends together.

Therefore, it would be highly desirable to have a new and improved method and apparatus for making a frayless line, which has both of its ends finished and which would not required the use of fasteners or tying techniques so as to reduce manufacturing costs.

DISCLOSURE OF INVENTION

Therefore, it is the principal object of the present invention to provide a new and improved frayless line, as well as a method and apparatus for making it, in a simple an efficient manner.

Another object of the present invention is to provide such a method and apparatus producing a finished end line, which does not require any hooks, wires or any other means to be secured within the line to prevent or at least limit greatly any unraveling.

Another object of the present invention is to provide such a method and apparatus for producing such a frayless line in a relative inexpensive manner.

Briefly, the above and further objects of the present invention are realized by providing a method and apparatus for producing a frayless line in a relatively inexpensive manner, wherein the line has two finished ends not secured by the use of fasteners.

The apparatus includes a winder for rotating individually a plurality of individual strand end holding devices, and a spreader for separating groups of strands in a spaced apart manner at a selected point intermediate the strand ends, so the strand groups may be freely and easily twisted together. A slidable rotatable support twists a plurality of individual group of strands together to form a line.

The method of making the frayless line includes winding the ends of a strand of material between a winder and a spreader to form at least one group of strands. The group of strands is then twisted to form a twisted group of strands with a finished looped end. The free ends of the strand are then inserted into the twisted group of strands, and the apex of the group of strands formed at the spreader are then connected to a rotatable strand holding device. The device is then rotated to twist the group of strands to form a line with a finished end formed on the rotatable device.

A probe with a sleeve thereon is used to remove the finished looped end from the winder so that the loop surrounds the sleeve. The probe is removed from the sleeve, and the finished end of the line is then removed from the rotatable device so that the finished end of the line can be inserted into and through the sleeve. The sleeve is then slid to the opposite end of the line, and the finished loop can then be removed from the sleeve for surrounding the line at one end thereof, thereby restraining the line from unraveling. The sleeve is removed from the line, thereby forming a line with both of its terminal ends finished.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figures 4, 9, 11, 12:
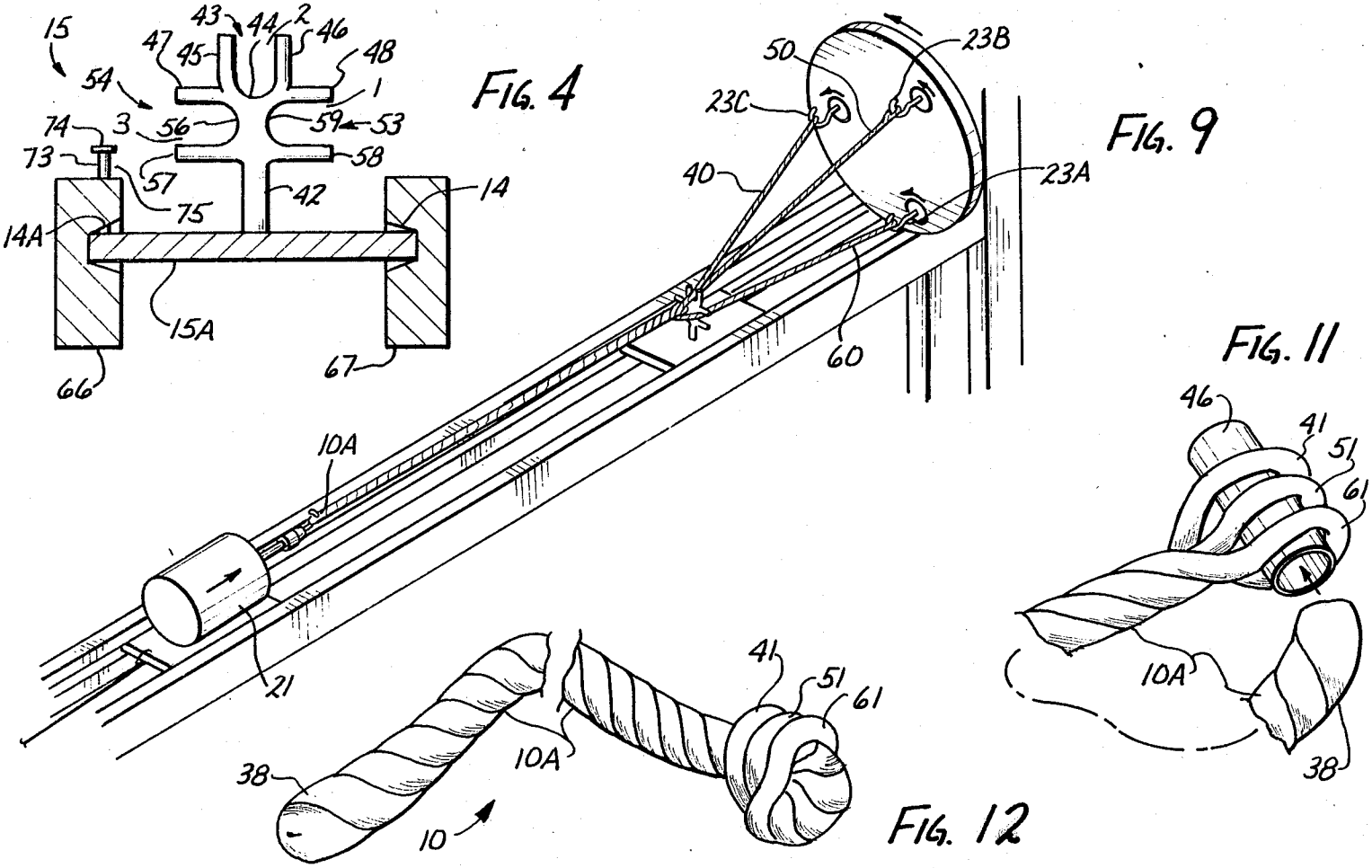
FIG. 4 is a greatly enlarged sectional elevational view of a spreader which forms a part of the apparatus of FIG. 1.
FIGS. 5–11 are views of successive steps in the method of making a frayless line of the present invention.
FIG. 12 is a fragmentary pictorial view of a completed frayless line, which is constructed in accordance with the present invention.

Referring now to the drawings, and more particularly to FIG. 12, there is shown a frayless line 10, which is constructed in accordance with the present invention.

The line 10 generally comprises a twisted strand body portion 10A having a frayless end 38. At the opposite end thereof, a plurality of frayless looped strand ends 41, 51 and 61 encircle tightly the body portion 10A. The body portion 10A of the line has extends through the looped ends, which are reversely looped back on themselves thereby restraining the twisted strand line from unraveling, without the need for any device or other technique from preventing such undesirable unraveling Referring now to the drawings, and more particularly to FIG. 1, there is shown an apparatus 11 for making the frayless line 10 of FIG. 12. The apparatus 11 generally comprises a base support or frame 13 having a pair of horizontal spaced apart tracks 14 and 14A which are adapted to receive and support slidably a motor support 16 and a spreader base member 15A on which is mounted in an upright manner a strand spreader 15. A weight 17 is mounted on the support 13 by being suspended by a cord 18 which passes over a set of pulleys 12, 19 and 20 which are rotatably mounted respectively at 12A, 19A and 20A on support 13. The other end of the cord 18 is secured to the motor support 16 for urging it away from the spreader 15.

Figures 1, 2, 3:
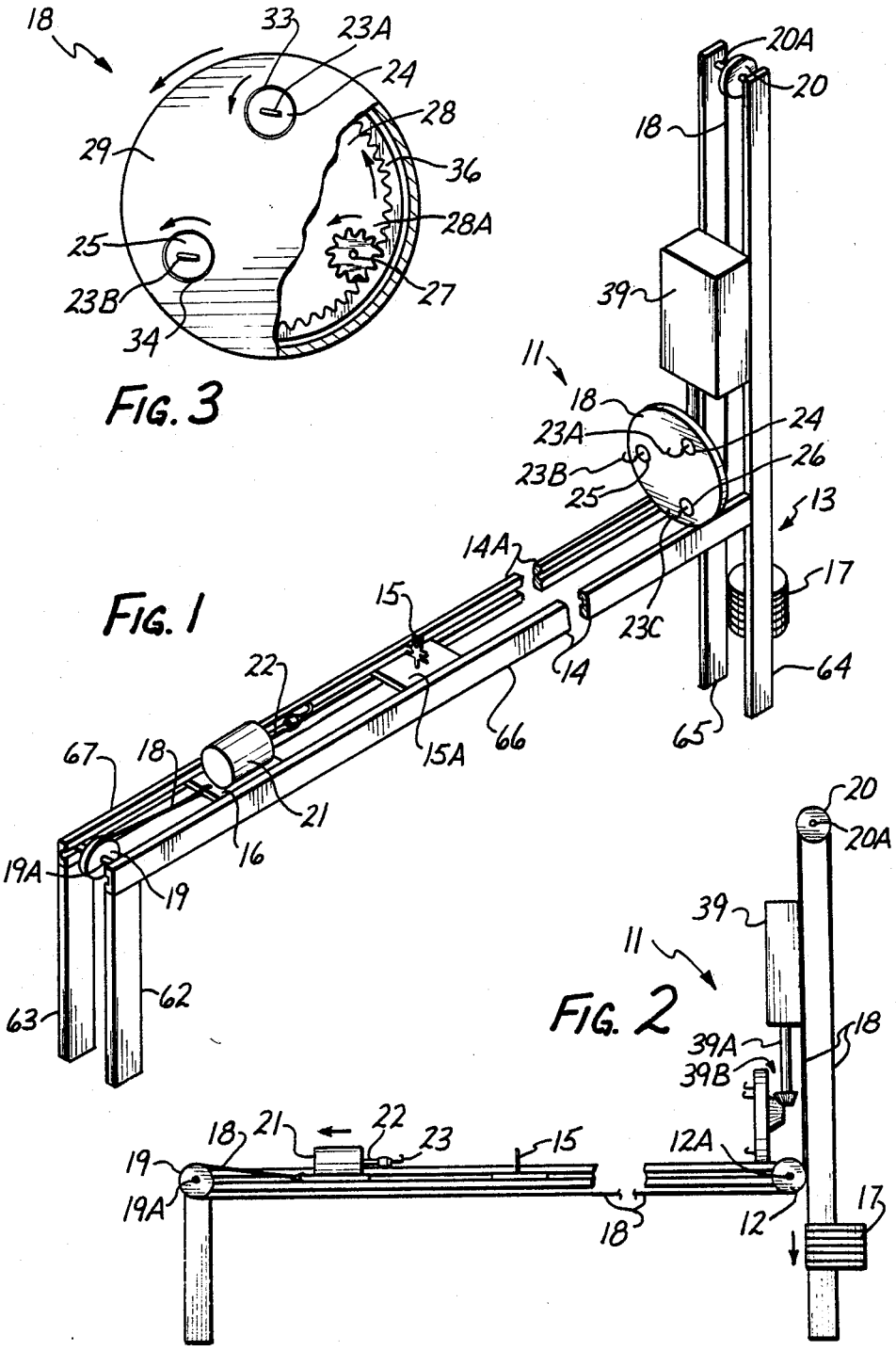
FIG. 1 is a pictorial view of the apparatus for making a frayless line, which apparatus is constructed in accordance with the present invention.
FIG. 2 is a reduced scale elevational view of the apparatus of FIG. 1.
FIG. 3 is a partially broken away greatly enlarged face view of the winder of the apparatus of FIG. 1.

A motor 21 is mounted on the support 16 and has a shaft 22 which terminates in hook 23. The hook 23 is fixedly positioned on shaft 22, and rotates about the center axis of the shaft 22 as it is rotatably driven by the motor 21 t rotate the end 38 of the line 10 of FIG. 12. A winder 18 is fixed on the support or frame 13 in a spaced apart relation relative to the spreader 15 along the longitudinal axis of the tracks 14 and 14A. A set of three hooks 23A, 23B and 23C are fixedly mounted to rotatable plates 24, 25 and 26 to twist the respective looped strand ends 41, 51 and 61 (FIG. 12). A set of three hook plates 24, 25 and 26 have the hooks extending therefrom and are each rotatably attached to the outside of the plate 29 and are driven rotatably by a set of three gears, such as a gear 27 adapted to be rotatably driven by a motor 39 mounted to base support 13, as best seen in FIG. 2 via a drive shaft 39A, and a gear train 39B for driving the ring gear 36.

Figures 5, 6:
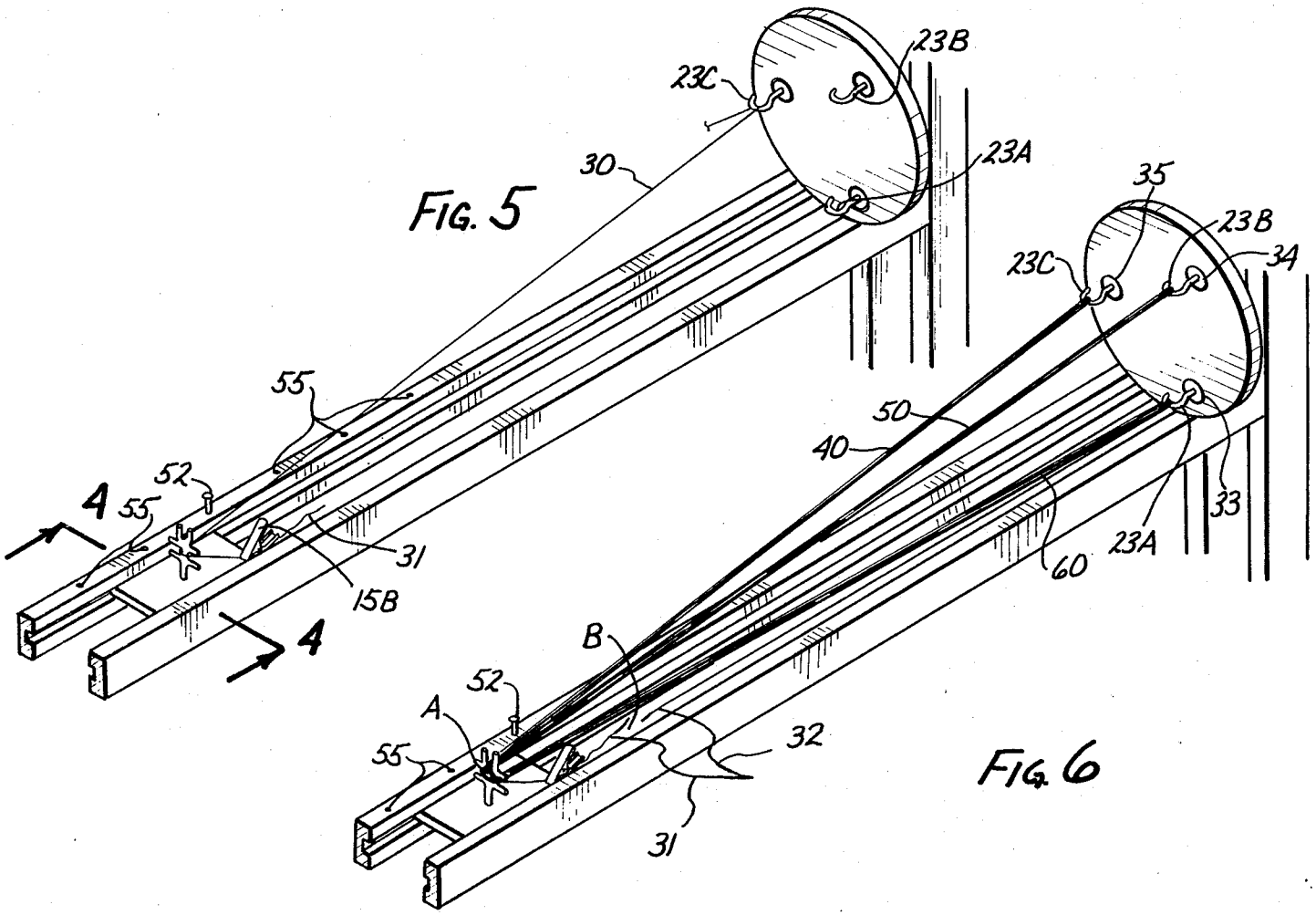

Referring now to FIGS. 4–11, the method of manufacturing the line 10 using the apparatus 11 will now be described. In operation, as shown in FIGS. 5 and 6, an operator using apparatus 11 commences manufacture by hand winding a strand 30 of material stored on a spool (not shown) between spreader 15 and the hooks 23A, 23B, and 23C, a predetermined number of convolutions or turns, and in a specific pattern to form three groups of strands 40, 50 and 60. Preparatory to winding the strand 30 from the spool, a free end 31 of the strand is secured by a clip 15B.

Referring to FIGS. 4, 5, and 6, the strand 30 is drawn from the spool and wrapped about the spreader 15, through a space at point 1 of the spreader 15, a space at point 3 thereof, then to hook 23C, then back to point 3, over to point 2, then to hook 23B to form eventually strand group 60, then back to spreader point 2, then to point 1, then to hook 23C, then back to point 1, and then to point 3. This process is then repeated a predetermined number of times, such as eight times to form the strand groups 40, 50 and 60.

The number of threading cycles repeated thereafter depends upon the desired diameter for the completed line 10. When the threading cycles are completed, there are three groups of strands 40, 50 and 60 as shown in FIG. 6, wherein the strand group 40 extends from spreader 15 point 3 to hook 23A, strand group 50 extends from spreader 15 at point 2 thereof to hook 23B, and strand group 60 extends from spreader 15, point 1 to hook 23C. It should be apparent that the number of strands in each strand group can be predetermined as desired, and that the three strand groups have a common apex point A (FIG. 6) on spreader 15.

When the desired number of strands have been threaded on the hooks and spreader as just described, the length of strand 30 is cut to provide a second free end 32 as shown at B in FIG. 6, free end 31 and 32 are then inserted and buried among the strands of either strand groups 40, 50, or 60 as the operator may choose. With the free ends so positioned, hooks 23A, 23B, and 23C are then rotated independently at the same speed and in the same counterclockwise direction as indicated by the arrows shown in FIG. 7. This action twists the convoluted wound strands of each respective group 40, 50, and 60, since spreader 15 remains stationary, thereby holding against rotation apex A of the strand groups where they merge together, and the free ends 31 and 32 are thus captured and buried within the twisted groups.

Figures 7, 8, 10:
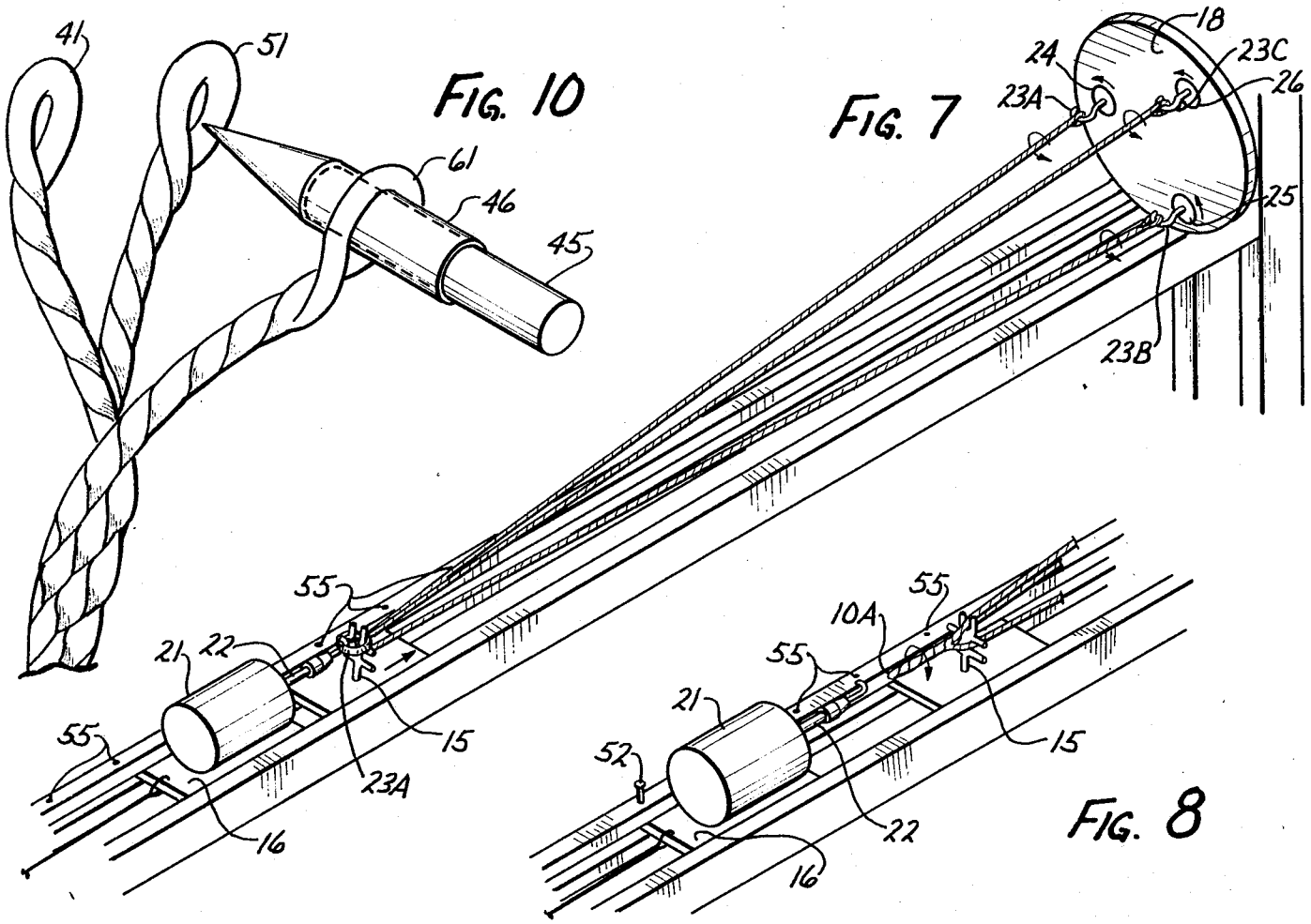

As shown in FIG. 4, a pin 75 fixes releasably the spreader 15 to the track 14A during the initial winding operation of FIGS. 5, 6 and 7. Furthermore, for this purpose, the motor hook 23 is attached by means of a ring 23A (FIG. 7) slipped over the spreader 15.

After the individual strand groups 40, 50 and 60 have been twisted as shown in FIG. 9, the motor support 16 is slidably positioned so that hook 23 is directly adjacent to the apex A of the strand groups and the ring 23A is removed. Hook 23 is then manually hooked onto apex A of the strand groups until all the strands rest securely thereon. Once all the strands are securely resting on hook 23 as indicated in FIG. 8, the shaft 22 is hand rotated to form a first portion of the finished end 38 of line 10. Thereafter, both motors 21 and 39 are activated so that the ring gear 36 of the winder 18 is rotated at a speed, so that the driven gears, such as the gear 27, rotates at a higher speed as compared to the speed of the ring gear and the shaft 22, but in the opposite direction to the direction of the shaft 22 Thus, the hooks 23A, 23B, and 23C are rotated by their respective plates 24, 25 and 26 at a higher speed and in the same direction as the plate 28.

As this rotation continues, spreader base 15A is pulled along tracks 14 and 14A toward the winder 18 as the line body 10A is being formed, while the tension force applied to motor support 16 by weight 17 via the cable 18, maintains the twisted body portion 10A taught, so it does not kink as spreader 15 translates along the tracks 14 and 14A. As spreader 15 approaches winder 18, the angles between adjacent strand groups 40, 50 and 60 becomes greater, until the individual strand groups are pulled free from spreader 15 as it advances out of engagement with the strand groups, leaving three twisted strand groups 40, 50 and 60 with three finished end loops 41, 51 nd 61 as illustrated in FIGS. 10 and 11.

As indicated in FIG. 10, a pointed probe 45 having a sleeve 46 slipped thereon, is then used to remove each looped end of the twisted grouped strands 40, 50 and 60 from their respective hooks 23A, 23B, and 23C of the winder 18. As each loop is removed from its respective hook, the removed loop is oriented on probe 45 so it surrounds the sleeve 46. This process is repeated until all the looped ends have been removed from winder 18 and surround sleeve 46 as illustrated in FIG. 11.

Referring now to FIG. 11, probe 45 is removed from sleeve 46 which now comprises a hollow tube of sufficient diameter to receive the opposite end 38 o the body portion 10A. The end 38 is removed from hook 34 and inserted into and through sleeve 46 so that sleeve 46 can be slid along the body portion 10A to the opposite end thereof Once the sleeve 46 is positioned at this opposite end, the loops 41, 51 and 61 are removed from sleeve 46, thereby surrounding the twisted group strands of line 10 at one of its terminal ends as shown in FIG. 12. Sleeve 46 is then slid along line body 10A until the sleeve is removed at the opposite end 38, thus forming the line 10 having frayless ends as shown in FIG. 12.

Considering now base support 13 in greater detail with reference to FIGS. 1 and 2, the base support 13 includes a plurality of legs 62, 63, 4, and 65. Legs 64 and 65 are substantially longer than legs 62 and 63. An elongated member 66 extends between legs 62 and 64 and an elongated member 67 extends between legs 63 and 65. A groove 14 traverses along the longitudinal axis on the inner surface of members 66 and 67 to form track 14. Mounted slidably within the tracks 14 and 14A is a spreader base 15A which supports spreader 15 and a support base 16 which supports motor spreader 21 base 15A includes a groove (not shown) in its upper surface which is adapted to receive a pin 52 having an elongated shaft 53 terminating in a substantially flat head 54 that is generally circular in shape. Adjacent the terminal ends of members 66 and 67 and perpendicular to legs 62 and 63 is a rotatably mounted pulley 19 having a shaft 19A that is connected between members 66 and 67 as shown in FIG. 1. Adjacent the upper terminal ends of legs 64 and 65 and perpendicular thereto is a rotatably mounted pulley 20 having a shaft 20A that is connected between members 64 and 65.

Base-support 16 carries a weight 17 which is secured thereto by a cord 18 which passes over pulleys 19 and 20. A plurality of holes generally shown at 55 are spaced along the longitudinal axis of the upper surface of member 67. These holes are adapted to receive pin 52 to releasably secure spreader base 15A in a temporarily fixed position in relation to winder 18.

Considering now winder 18 in greater detail with reference to FIG. 3, the winder is generally circular in plan view having the plate 29 with three holes 33, 34 and 35 therein spaced equally about the circumference of the plate 29. Holes 33, 34 and 35 are adapted to receive the hook plates 24, 25 and 26 in a flush manner.

Each of the plates 24, 25 and 26 are similar in construction and only the plate 24 will now be described in greater detail. The inner face of plate 24 is connected to a gear 27, and the rear plate 28 rotates about its axis relative to the front fixed plate 29. The hook 23A is fixedly positioned and projects forwardly from the outer surface of the plate 24. Plate 24 includes a set of bearings (not shown) which allows plate 24 to rotate freely about its center axis as its gear (not shown) of surface 28 as it is driven by the ring gear 36.

Considering now spreader 15 in greater detail with reference to FIG. 4, spreader 15 is constructed of any rigid material and includes a shank member 42 with one terminal end thereof terminating in base 15A and its opposite end terminating in a U-shaped yoke member 43. Yoke member 43 is of integral construction having a base portion 44 and two equally spaced side arm portions 45 and 46 that extend perpendicularly from base 44. A pair of outer arm portions 47 and 48 extend laterally from base 44 in diametrically opposite directions and perpendicularly to side arm portions 45 and 46. Spaced from said outer arm portions and closer to base 15A are a pair of inner arm portions 57 and 58 that extend laterally from shank 42 and in diametrically opposite directions. Outer arm portion 47 and inner arm portion 57 are parallel in a planar surface and define spaced apart side arm portions o a second U-shaped yoke member 54 having a base portion 56 and that extend laterally from shank 42.

Similarly, outer arm portions 48 and inner arm portion 58 are parallel in planar surface and define spaced apart side arm portions of a third U-shaped yoke member 53 having a base portion 59 and that extends laterally from shank 42 but in a diametrically opposite direction from yoke member 54.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A device for making a line comprising:

a strand winder, having means rotatable about a fixed axis and having strand-engaging surfaces on a plurality of strand engaging means radially spaced from the center of said axis;

first driving means for rotating each one of said surfaces of said strand winder about a plurality of second axes, spaced from said axis, in a given direction of rotation;

a strand spreader for receiving a length of strand extending from said strand winder to said strand spreader;

means for slidably mounted said spreader in spaced apart relation along a longitudinal axis extending from said winder to said spreader wherein the distance between said spreader and said winder is determined by the length of line to be formed;

a support member for receiving the apex of a group of twisted strands that have been extended between said winder and said spreader, said support member being rotatable about a fixed axis having strand engaging means at the center of its axis of rotation, said support member being slidably mounted in said mounting means in a spaced apart relation along a longitudinal axis extending from said spreader to said support member;

second driving means for rotating the strand engaging means of said support member about its fixed axis in a direction opposite to said given direction for causing a plurality of individual strands to be twisted individually in said given direction while simultaneously twisting the opposite end in said opposite direction to form a finished end thereat;

said second driving means causing said strand spreader to be pulled toward said strand winder as it rotates the strand engaging means of said support member;

said strand spreader including means for freeing the group of twisted strands from said strand spreader as the spreader is pulled toward said winder to form a plurality of twisted strand groups each having a finished end loop;

said means for freezing including a shank member having one end affixed to said means for slidably mounting said spreader and its opposite end terminating in a plurality of integrally connected U-shaped yoke members; and said integrally connected U-shaped yoke members having a base portion, two equally spaced side arm portions extending perpendicularly from said base portion, a pair of outer arm portions extending laterally from said base portion in diametrically opposite directions and perpendicularly to said side arm portions and spaced from outer arm portions and closer to said means for slidably mounting said spreader, and a pair of inner arm portions that extend laterally from said shank member and in diametrically opposite directions.

2. The device of claim 1, including means for applying a constant tension along a longitudinal axis extending from the center axis of said support member to the center axis of said strand winder.

3. The device of claim 2, wherein said tension means comprises:

a cable;

means for mounting said cable in parallel to the center axis of said support member;

at least one pulley for receiving said cable; and a weight attached to the free end of said cable for transferring the force of gravity applied to said weight, when said weight is held off a stationary surface, to said cable to apply a constant tension force at the opposite end of said cable when mounted to said support member.

4. A method of making a line having finished ends comprising:

winding a single strand having two free ends between two supports to form at least two groups of strands;

rotating one of said supports a predetermined number of revolutions while holding the other support stationary to form a twisted plurality of groups of strands with a single finished end;

burying both free ends of said strand within the twisted groups of strands;

rotating the opposite support a predetermined number of revolutions to permit the groups of strands to twist together to form an elongated line having a plurality of finished ends;

using a probe with a sleeve to transfer the plurality of finished ends of the line off one of said supports and onto the sleeve;

removing the probe from the sleeve;

removing the single finished end of the line from the opposite support and inserting said single free end of the line into and through the sleeve;

translating the sleeve to the opposite end of the line;

removing the plurality of finished ends of the line from the sleeve; and removing the sleeve from the line.

5. The method according to claim 4, wherein the step of winding a single strand having two free ends between two supports to form a line having a single finished end at one end thereof and a plurality of finished ends at the opposite end thereof comprises the steps of:

temporarily securing a length of strand having a first free end upon a first prong of a prong spreader having a plurality of prongs;

extending the length of strand from the first prong of said prong spreader to a first hook of a line winder having a plurality of hooks;

extending the length of strand from the first hook of said winder back to the first prong of said spreader;

extending the length of strand from the first prong to a second prong of said spreader;

extending the length of strand from the second prong of said spreader to a second hook of said winder;

extending the length of strand from the second hook of said winder back to the second prong of said spreader;

extending the length of strand from the second prong of said spreader to a third prong of said spreader;

extending the length of strand from the third prong of said spreader to a third hook of said winder;

extending the length of strand from the third hook of said winder back to the third prong of said spreader;

extending the length of strand from the third prong of said spreader to the first prong of said spreader;

continuing to thread said length of strand in the manner described to form three strand groups of predetermined side having a common apex at said spreader, and a separate apex for each strand group at said winder;

cutting the length of strand to from a second free end;

rotating each hook of said winder while holding the spreader stationary to produce three twisted strand groups;

stopping the rotating after a predetermined twisting of said strand group has occurred;

twisting the first strand group in the opposite direction from the aforesaid rotation until an opening of the strands occurs;

inserting the first free end of the strand into said opening and releasing the first strand group to allow said group to freely retwist;

twisting the second strand group in the opposite direction from the aforesaid rotation until an opening of the strands occurs;

inserting the second free end of the strand into said opening and releasing the second strand group to allow said strand group to freely retwist;

connecting a rotatable support to the apex of the three strand groups formed at said spreader;

rotating said hooks in one direction while rotating the rotatable support in the opposite direction to permit the twisted strand groups to twist together upon themselves and be removed from said spreader to form an elongated line; and stopping the rotating after a predetermined twisting of said strand groups has occurred.

* * * * *

UNITED STATES PATENT AND TRADEMARK OFFICE

CERTIFICATE OF CORRECTION

PATENT NO. : 4,910,952

DATED : March 27, 1990

INVENTOR(S) : Dale Johnson

It is certified that error appears in the above-identified patent and that said Letters Patent is hereby corrected as shown below:

In the title, before "method", insert --A--.

Column 3, line 23, after "21", delete "t", and substitute therefor --to--.

Column 4, line 4, after "described", delete "." and substitute --,--.

Column 4, line 53, delete "nd" and substitute --and--.

Column 4, line 66," changing 38 o the body,"to read -- 38 of the body--.

Column 5, line 11, after "63," delete "4", and substitute --64--.

Column 6, line 2, after "portions", delete "o", and substitute --of--.

Column 6, line 61, after "for", delete "freezing", and substitute --freeing--.

Column 7, line 4, after "from", insert --said--.

Column 8, line 27, delete "side", and substitute --size--.

Column 5, line 2, after "therof", insert --.--.

Signed and Sealed this

Twenty-seventh Day of October, 1992

*Attest:*

DOUGLAS B. COMER

*Attesting Officer*

*Acting Commissioner of Patents and Trademarks*